US006551139B1

(12) United States Patent
Yu

(10) Patent No.: US 6,551,139 B1
(45) Date of Patent: Apr. 22, 2003

(54) ELECTRICAL CONNECTOR HAVING SHIELDING PLATE

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/013,416

(22) Filed: Dec. 7, 2001

(51) Int. Cl.[7] ..... H01R 13/648
(52) U.S. Cl. ..... 439/607; 439/101
(58) Field of Search ..... 439/607–610, 439/95, 101, 108

(56) References Cited

U.S. PATENT DOCUMENTS 5,876,247 A * 3/1999 Hashimoto ..... 439/607
6,033,236 A * 3/2000 McHugh et al. ..... 439/607
6,042,398 A * 3/2000 Wu et al. ..... 439/607
6,394,841 B1 * 5/2002 Matsuura ..... 439/607

* cited by examiner

*Primary Examiner*—Hien Vu
(74) *Attorney, Agent, or Firm*—Wei Te Chung

(57) ABSTRACT

An electrical connector (1) includes a housing (10) and a pair of shielding plates (20) attached to opposite sides of the housing. The housing has opposite side walls (12), a slot (11) between the side walls and a plurality of terminal passages (13) in communication with the slot. Each side wall has a plurality of retainers (14) for securing the shielding plate. Each plate has a plurality of grounding terminals (22) received in the terminal passages of the housing for electrically mating with a complementary connector. A plurality of soldering tails (23) extends from each of the shielding plates opposite to the grounding terminals for being soldered to and securely electrically connected with a printed circuit board.

3 Claims, 4 Drawing Sheets

ELECTRICAL CONNECTOR HAVING SHIELDING PLATE

BACKGROUND OF THE INVENTION

1. Field of the Invention

The present invention relates to electrical connectors, and particularly to an electrical connector having a shielding plate.

2. Prior Art

Nowadays, electrical signal transmissions tend to be high speed and high frequency which easily cause electromagnetic interference between electronic devices. A conventional electrical connector normally has a metal shielding plate grounded to prevent electromagnetic interference during signal transmitting, thereby assuring stable signal transmitting.

FIG. 1 shows a conventional electrical connector 2. The electrical connector 2 includes a plurality of grounding terminals 3 and two shielding plates 4. Each shielding plate 4 has a plurality of grounding tabs 5 which are bent to electrically contact corresponding grounding terminals 3 thereby reducing electromagnetic interference.

However, the electrical contact between the grounding terminals and the grounding tabs is not secure in use. When the grounding terminals or the grounding tabs are deformed or the connector 2 is under vibration, the electrical contact therebetween is adversely affected.

SUMMARY OF THE INVENTION

Accordingly, an object of the present invention is to provide an electrical connector having a shielding plate for providing secure grounding paths thereby preventing electromagnetic interference.

To achieve the above-mentioned object, an electrical connector in accordance with the present invention includes a housing and a pair of shielding plates attached to opposites sides of the housing. The housing has opposite side walls, a slot between the side walls and a plurality of terminal passages in communication with the slot. Each side wall has a plurality of retainers for securing one of the shielding plates. Each plate has a plurality of grounding terminals received in the terminal passages of the housing for electrically mating with a complementary connector. A plurality of soldering tails extends from each of the shielding plates opposite to the grounding terminals for being soldered to and securely electrically connected with a printed circuit board.

Other objects, advantages and novel features of the present invention will be drawn from the following detailed description of a preferred embodiment of the present invention with attached drawings, in which:

DETAILED DESCRIPTION OF THE PREFERRED EMBODIMENT

Figure 1:
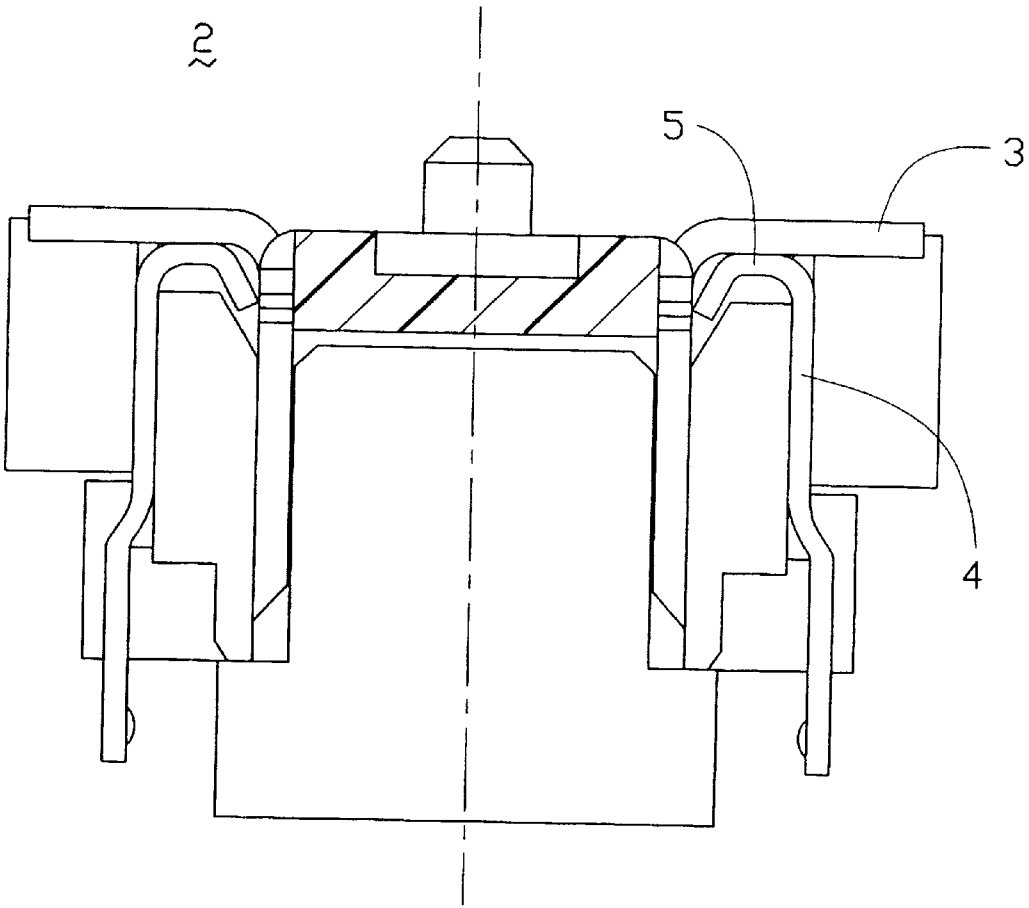
FIG. 1 (PRIOR ART)
FIG. 1 is a cross-sectional view of a conventional electrical connector.
Figure 2:
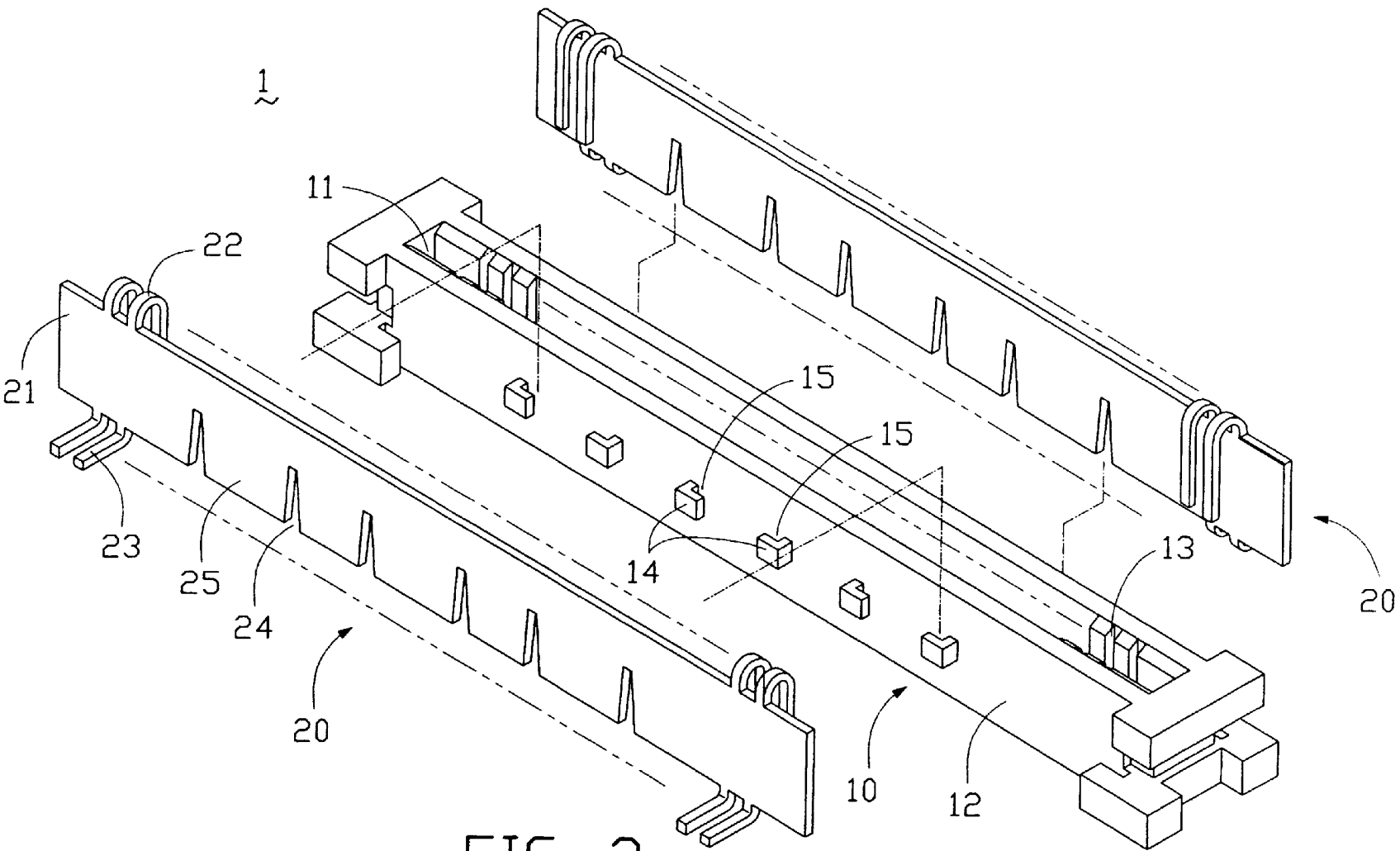
FIG. 2 is an exploded view of an electrical connector in accordance with the present invention.

Referring to FIG. 2, an electrical connector 1 in accordance with the present invention includes a dielectric housing 10 and a pair of shielding plates 20 attached to opposite sides of the housing 10. An elongate slot 11 is defined in the housing 10 and therefore the housing 10 has two opposite side walls 12. A plurality of spaced terminal passages 13 is defined in an inner side of the side wall 12 in communication with the slot 11. The passages 13 extend from a top surface of the housing 10 to a bottom surface of the housing 10. Three pairs of L-shaped retainers 14 are formed at outer side of each side wall 12. A receiving space is defined between one pair of the retainers 14.

Each shielding plate 20 includes a base 21, a plurality of grounding terminals 22 extending from a top portion of the base 21 and a plurality of soldering tails 23 extending from a bottom portion of the base 21. Three pairs of cutouts 24 are defined in the bottom portion of the base 21 thereby forming three retaining tabs 25 in the base 21. Each grounding terminal 22 is bent downwards to one side of the base 21. Each solder tail 23 is bent horizontally to another side of the base 21 for being soldered to and electrically connected with a printed circuit board (not shown).

Figure 3:
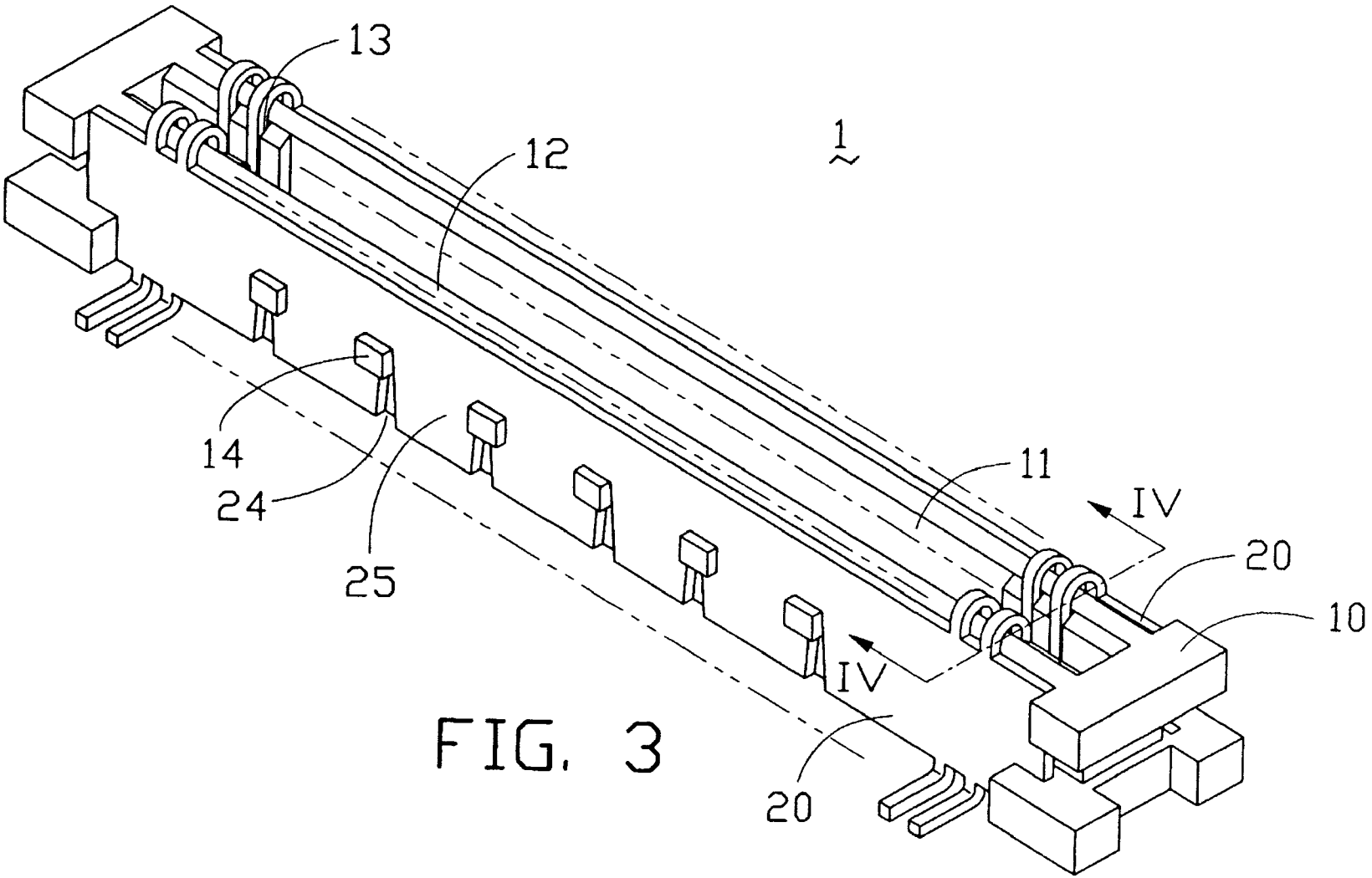
FIG. 3 is an assembled view of FIG. 2.
Figure 4:
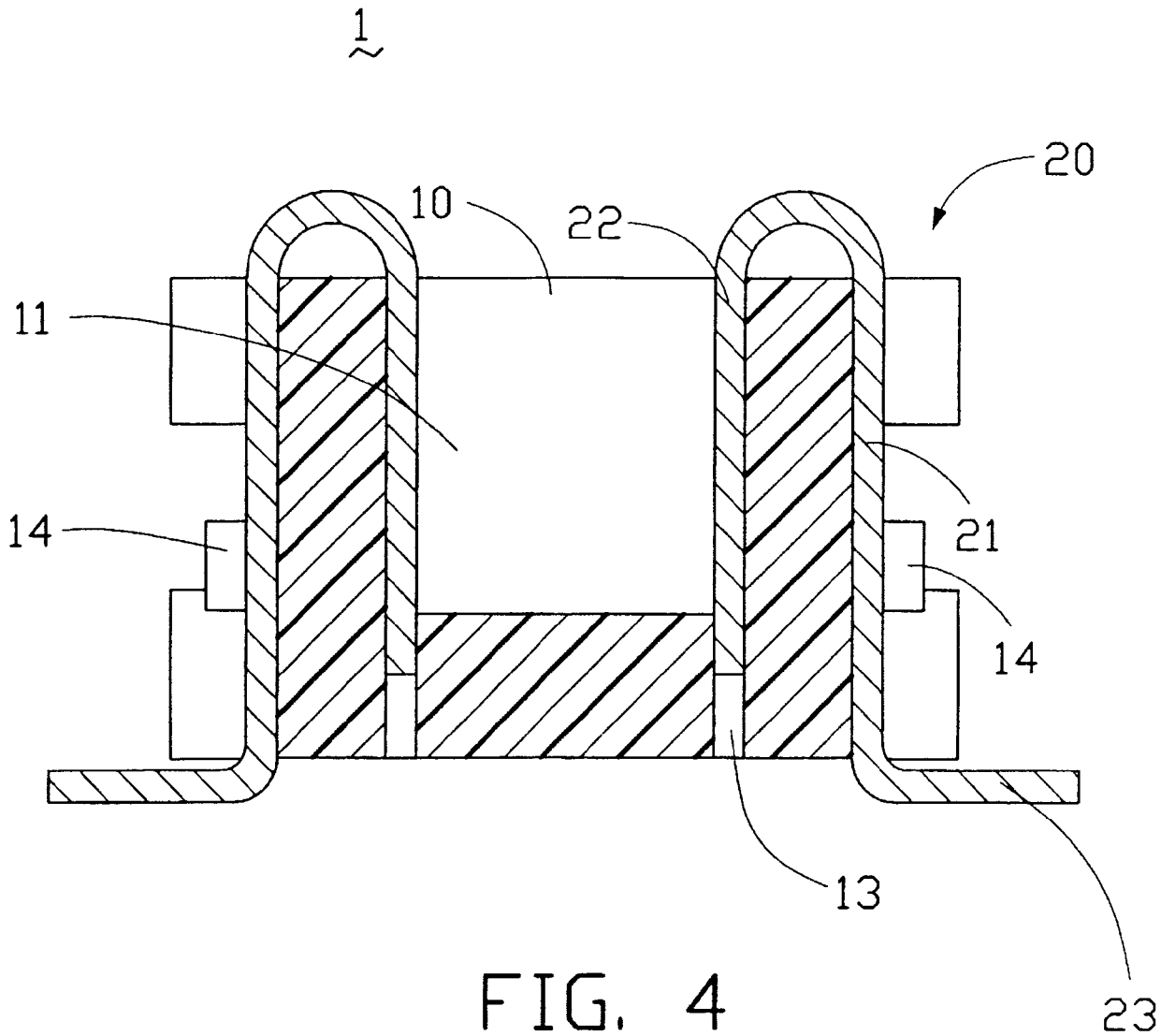
FIG. 4 is a cross-sectional view taken along line IV—IV of FIG. 3.

Referring to FIGS. 3 and 4, in assembly, the shielding plates 20 are attached to the side walls 12 with each of the retaining tabs 25 thereof being secured between each pair of the retainers 14 of the housing 10. The grounding terminals 22 are received respectively in the terminal passages 13 of the housing 10 for electrically mating with grounding contacts of a complementary connector (not shown). Thus, secure grounding paths are formed through the shielding plates 20 which has grounding terminals 22 mating with complementary connector and soldering tails 23 soldered to the printed circuit board.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. An electrical connector comprising:

a housing having opposite side walls, a slot between the side walls and a plurality of terminal passages opened in the side walls in communication with the slot; and a pair of shielding plates attached respectively to the side walls of the housing, each shielding plate having a plurality of grounding terminals extending from an upper edge of the shielding plate downwardly into the terminal passages of the housing for electrically mating with grounding terminals of a complementary connector; wherein each of the side walls of the housing forms several pairs of retainers extending outwardly from a middle portion thereof for securing the shielding plate; wherein each of the shielding plates has a plurality of retaining tabs each secured between one pair of retainers of the housing; wherein each retainer is substantially L-shaped and a receiving space is defined between one pair of retainers and securely receives one retaining tab of the shielding plate.

2. The electrical connector as claimed in claim 1, wherein a plurality of tails extends from the shielding plate opposite to the grounding terminals for electrical contact with a printed circuit board.

3. An electrical connector comprising:

an insulative housing having opposite side walls with a slot therebetween, a plurality of terminal passages opened in the side walls in communication with the slot;

a pair of shielding plates attached to outer faces of said pair of side walls, each of said shielding plates including a plurality of grounding terminals extending from an upper edge thereof each with a semi-circle like bight portion above an upper face of the housing and a vertical section downwardly extending from said bight portion into a corresponding terminal passage; wherein the vertical section is configured to mechanically and electrically engage with another grounding contact of a complementary connector inserted into the slot, and the bight portion provides guiding and protection functions for insertion of said complementary connector; wherein each of the side walls of the housing forms several pairs of retainers extending outwardly from a middle portion thereof for securing the shielding plate; wherein each of the shielding plates has a plurality of retaining tabs each secured between one pair of retainers of the housing.

* * * * *